US010085505B2

(12) United States Patent
Williams

(10) Patent No.: US 10,085,505 B2
(45) Date of Patent: Oct. 2, 2018

(54) HAIR EXTENSION ATTACHMENT APPARATUS

(71) Applicant: Quintina Williams, West Bloomfield, MI (US)

(72) Inventor: Quintina Williams, West Bloomfield, MI (US)

( * ) Notice: Subject to any disclaimer, the term of this patent is extended or adjusted under 35 U.S.C. 154(b) by 184 days.

(21) Appl. No.: 14/943,698

(22) Filed: Nov. 17, 2015

(65) Prior Publication Data

US 2016/0135530 A1 May 19, 2016

Related U.S. Application Data

(60) Provisional application No. 62/081,055, filed on Nov. 18, 2014.

(51) Int. Cl.
*A41G 5/00* (2006.01)

(52) U.S. Cl.
CPC ..... *A41G 5/0073* (2013.01)

(58) Field of Classification Search
CPC ..... A41G 5/00; A41G 5/004; A41G 5/0046; A41G 5/0053; A41G 5/0073
USPC ..... 132/201, 53
See application file for complete search history.

(56) References Cited

U.S. PATENT DOCUMENTS 1,526,440 A * 2/1925 Skaruda ..... A41G 5/004 132/105
1,706,136 A * 3/1929 Beattie ..... A45D 2/42 132/144
1,775,209 A * 9/1930 Oppenheim ..... A41G 5/004 132/105
2,533,067 A * 12/1950 Taren ..... A45D 8/12 132/135
2,620,809 A * 12/1952 Rosen ..... A41G 5/004 132/276
3,120,852 A * 2/1964 Sawyer ..... A45D 8/12 132/145
5,657,774 A * 8/1997 Niese ..... A41G 5/0093 132/105
6,035,861 A 3/2000 Copello
6,688,315 B1 2/2004 Harrison
2008/0178902 A1 7/2008 Moeszinger
2008/0257369 A1 10/2008 Poole
2011/0253165 A1 10/2011 Kenna
2013/0233330 A1* 9/2013 Nagatomo ..... A45D 8/22 132/53

(Continued)

*Primary Examiner* — Cris L Rodriguez
*Assistant Examiner* — Brianne Kalach
(74) *Attorney, Agent, or Firm* — The Weintraub Group, P.L.C.

(57) ABSTRACT

A hair extension attachment apparatus for removably securing a hair extension to the user's hair. The hair extension attachment apparatus includes an elongated strip that is composed of a flexible material so that it can contour to the shape of the user's head. The front surface of the elongated strip includes one or more clamps thereon for securement to the user's hair. Each clamp includes a comb member and a closure member, wherein the closure member can be pivotally opened and closed in order to secure hair therein. The front surface further includes one or more hooks thereon for removably securing a hair extension to the elongated strip. The user can removably secure the hair extension within the hooks on the strip, and the strip is concealed by the hair extensions when applied to the user's hair.

9 Claims, 4 Drawing Sheets

(56) References Cited

U.S. PATENT DOCUMENTS

2016/0050996 A1* 2/2016 Kwon ..... A41G 3/0033
132/201

* cited by examiner

HAIR EXTENSION ATTACHMENT APPARATUS

CROSS REFERENCE TO RELATED APPLICATION

This application claims the benefit of U.S. Provisional Application No. 62/081,055 filed on Nov. 18, 2014. The above identified patent application is herein incorporated by reference in its entirety to provide continuity of disclosure.

BACKGROUND OF THE INVENTION

Field of the Invention

The present invention relates to a hair extension attachments. More specifically, the invention relates to a hair extension attachment apparatus that can be utilized in order to removably secure hair extensions to the user's hair.

Hair extensions are often used in order to make a person's hair appear to be thicker and fuller. However, hair extensions are often affixed to the user's hair using hair glue, which can damage the user's hair and can make it difficult to remove the extensions. Alternatively, hair extensions having wig comb attachments are often used to eliminate the difficulties of using hair glue. However, the use of such devices involves the use of hair extensions that are permanently affixed to a comb. This limits the user to one type of extension with one color, thickness, and length.

Further, the majority of hair extensions are merely small sections of hair and cover only a portion of one's head, thus requiring a user to insert several hair extension sections into one's hair in order to obtain a desired style, length, thickness, color and effect. This method of installing hair extensions can be a time consuming and tedious process, often requiring another person to assist the user in order to properly and securely affix the hair extensions into one's hair. Thus, a new and improved hair extension attachment apparatus that can be removably secured to the user's hair and that can removably receive a hair extension therein is desired.

SUMMARY OF THE INVENTION

In view of the foregoing disadvantages inherent in the known types of hair extension attachment devices now present in the prior art, the present invention provides a new hair extension attachment apparatus wherein the same can be utilized for providing convenience for the user when placing hair extensions into one's hair.

It is therefore an object of the present invention to provide a new and improved hair extension attachment apparatus that has all of the advantages of the prior art and none of the disadvantages.

It is another object of the present invention to provide a hair extension attachment apparatus that is flexible in order to conform to the shape of a user's head.

Another object of the present invention is to provide a hair extension attachment apparatus that remains hidden and unexposed when applied to a user's head.

Another object of the present invention is to provide a hair extension attachment apparatus having one or more clamps for attachment to the hair of the user.

Yet another object of the present invention is to provide a hair extension attachment apparatus having one or more hook fasteners in order to grasp and secure a hair extension therein.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
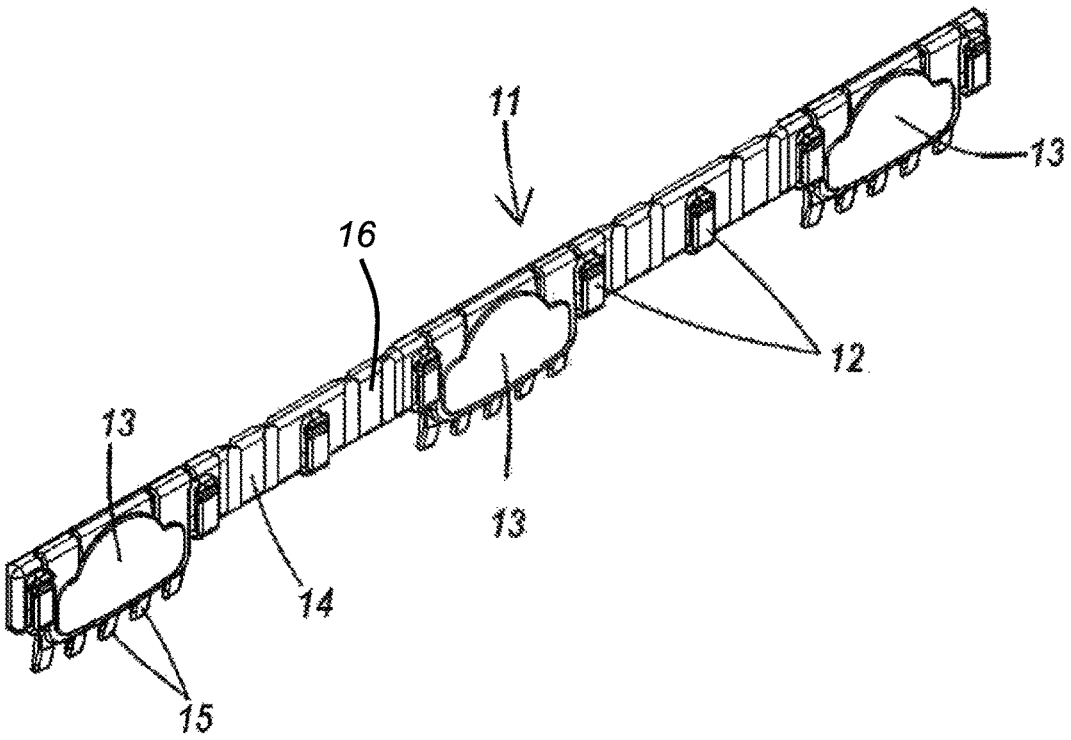
FIG. 1 shows a front view of the hair extension attachment apparatus of the present invention in a closed configuration.

Reference is made herein to the attached drawings. Like reference numerals are used throughout the drawings to depict like or similar elements of the hair extension attachment apparatus. For the purposes of presenting a brief and clear description of the present invention, the preferred embodiment will be discussed as used for holding and securing hair extensions therein and fastening the hair extensions to the user's hair. The figures are intended for representative purposes only and should not be considered to be limiting in any respect.

Figure 2:
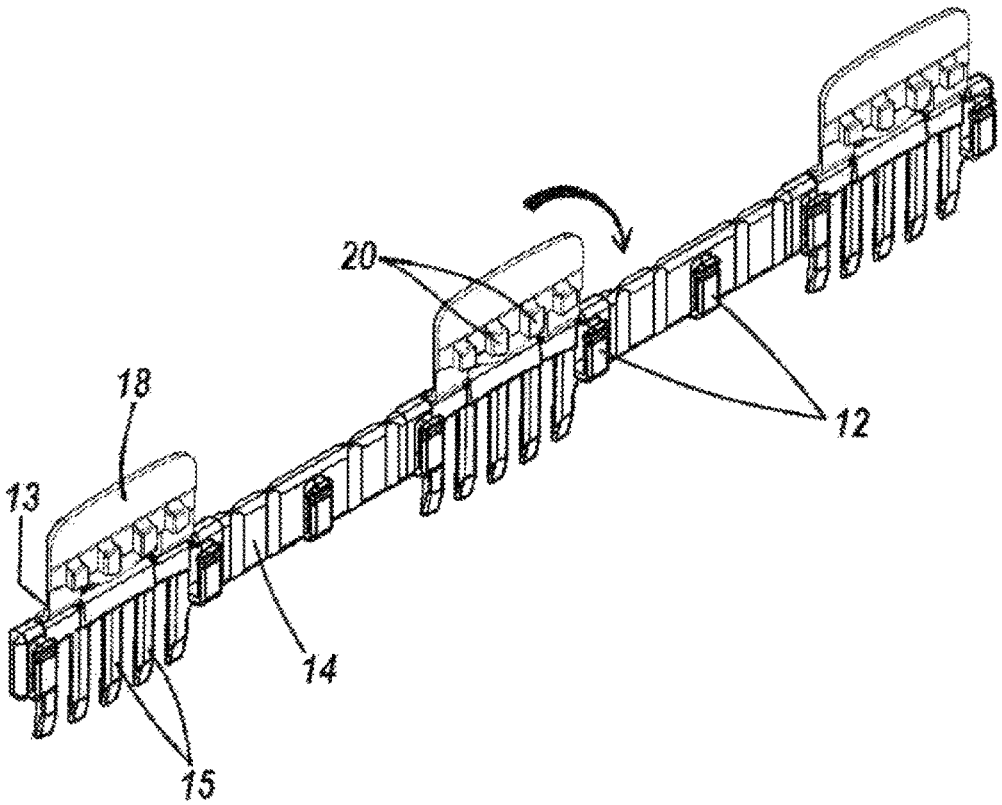
FIG. 2 shows a front view of the hair extension attachment apparatus of the present invention in an open configuration.

Referring now to FIGS. 1 and 2, there is shown a front view of the hair extension attachment apparatus in a closed configuration and an open configuration, respectively. The hair extension attachment apparatus 11 comprises an elongated strip 14 having a front surface 16 and a rear surface. The elongated strip 14 preferably comprises a substantially rectangular configuration and is composed of a flexible material that can contour to the shape of the user's head. The front surface 16 of the strip comprises one or more clamps 13 thereon that are adapted to be secured to the user's hair. The front surface 16 further comprises one or more hook fasteners 12 that are adapted to receive a hair extension thereon. The rear surface is preferably smooth and flat so that it can comfortably rest against the user's head. The elongated strip 14 is adapted to be disposed in a horizontal orientation in any of various positions on the user's head, such as on the front of the user's head or the rear of the user's head.

The clamps 13 are preferably spaced at a fixed interval on the elongated strip 14. Each clamp 13 comprises a comb member having a plurality of tines 15, wherein the tines 15 are linear in structure. Further, the tines 15 are arranged in a parallel orientation to one another and are spaced at a fixed interval. The spaces between the tines 15 are adapted to receive a plurality of strands of hair therethrough such that the plurality of tines 15 become interlocked with the user's hair. Each clamp 13 further comprises a closure member 18, wherein the closure member 18 comprises a rectangular shape in a preferred embodiment. The closure member 18 is pivotally affixed to an upper end of the comb member and is movable between an open configuration and a closed configuration. The closure member 18 is arranged in an open configuration so that hair can be inserted into the comb member, and then the closure member 18 is closed so as to secure the hair within the clamp 13.

An interior portion of the closure member 18 provides a plurality of teeth 20 that are arranged in a parallel and linear orientation in relation to one another in such a way that the plurality of teeth 20 align with the spaces between the plurality of tines 15 and are adapted to extend therethrough. When the closure member 18 is in a closed configuration, each tooth of the plurality of teeth 20 is secured in the spaces between the tines of the plurality of combs, respectively. This helps to secure the hair within the clamp 13 and helps to retain the clamp 13 in the closed configuration until it is desire to open the clamp 13.

Each clamp 13 can be moved from the closed configuration to the open configuration by applying manual pressure to the closure member 18 in order to disengage the teeth 20 from the plurality of tines 15. In this way, the user can easily detach the hair extension attachment apparatus 11 when it is no longer desired to be used.

One or more hooks 12 are also disposed on the front surface 16 of the hair extension attachment apparatus 11. The hooks 12 are disposed at a fixed interval from one another, and are preferably arranged in alternating fashion with the plurality of clamps 13. In the illustrated embodiment, the hooks 12 comprise an L-shaped configuration, wherein each hook 12 extends outward from the elongated strip 14 and comprises a portion that is substantially parallel to the front surface 16 of the elongated strip 14. Thus, the hook 12 provides a hollow channel that can receive the band of the hair extension. The hooks 12 are substantially rigid, yet provide a slight flexibility such that a hair extension can be applied thereto and secured therein.

Figure 3:
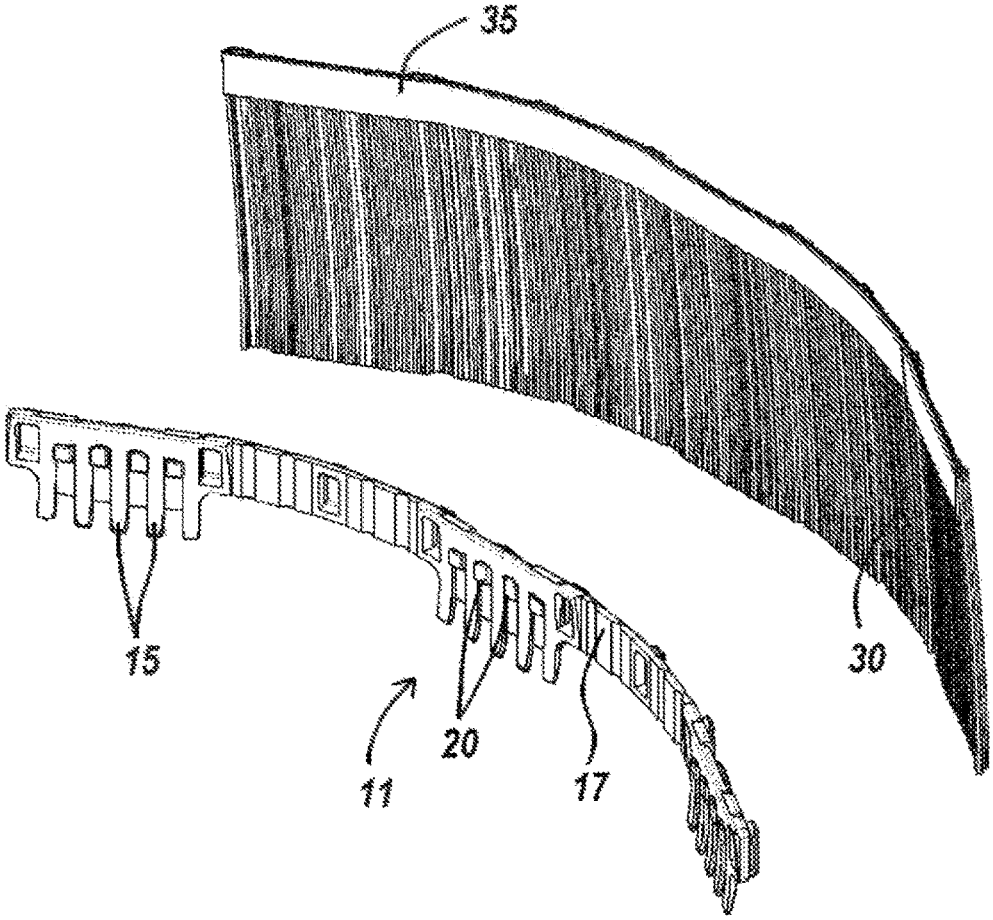
FIG. 3 shows a back view of the hair extension attachment apparatus of the present invention.
Figure 4:
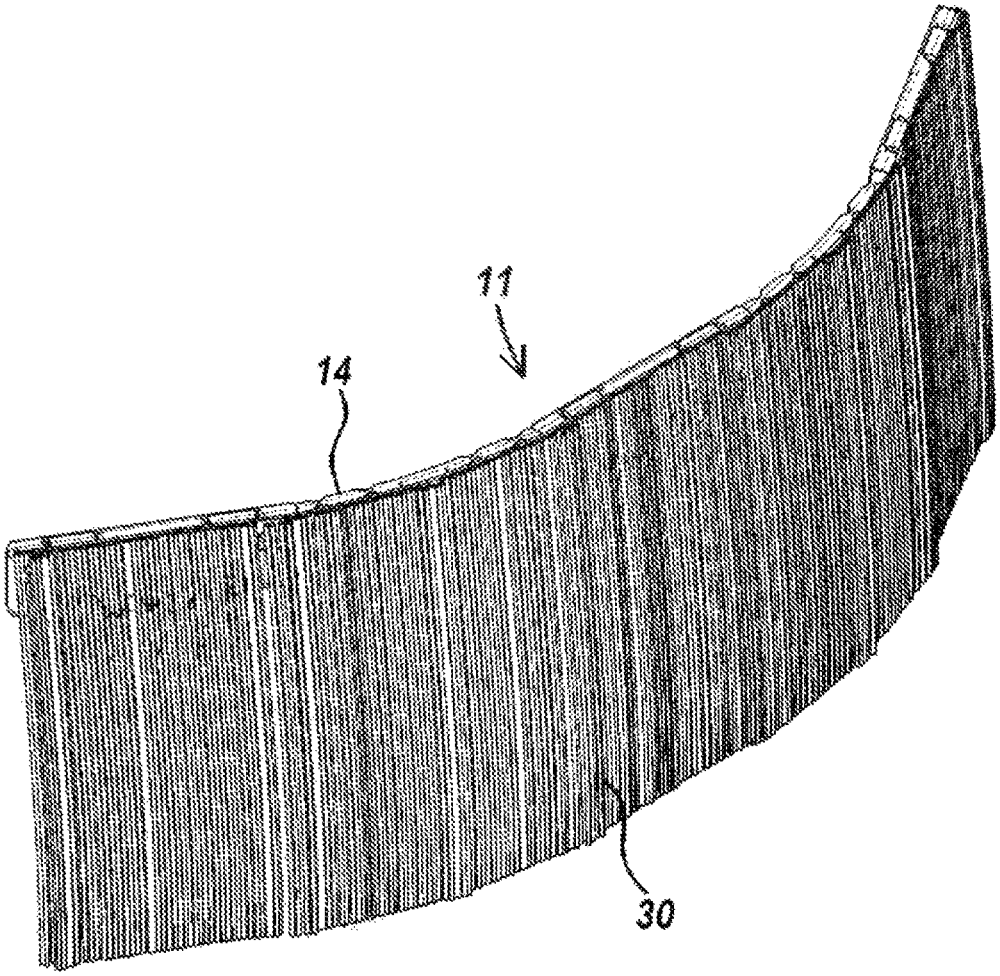
FIG. 4 shows a hair extension attached to the hair extension apparatus of the present invention.

Referring now to FIGS. 3 and 4, there is shown a back view of the hair extension attachment apparatus of the present invention, and a hair extension attached to the hair extension apparatus of the present invention, respectively. In operation, the user can manually grasp the hair extension 30, wherein the hair extension 30 comprises a planar structure having a substantially rectangular shape, a first side, a second side, a top and a bottom. The top of the hair extension provides a band 35 to which a plurality of faux hair strands are connected, forming one unitary body. The user can place the band 35 into the open end of the hooks of the hair extension apparatus such that it remains securely within the hollow channel. The hollow channel is such that it is very narrow that the band of the hair extension lies flush and snugly against the extension portion of the hook.

Once the hair extension 30 has been placed within the hooks of the hair extension apparatus 11, the strands of hair of the hair extension lay flush against the first side of the hair extension apparatus 11, covering the entirety of the hair extension apparatus 11. When the hair extension 30 has been applied to the hair extension apparatus 11, the hair extension apparatus 11 cannot be seen externally and appears to be regular strands of hair of the user. Thus, to the naked eye, the hair extension apparatus 11 will not be viewed once applied to the user's hair and the hair extension 30 attached thereto appears to be the user's genuine hair.

Thereafter, the user can manually grasp the hair extension apparatus 11 and position the strip such that the front surface of the hair extension apparatus 11 is facing outward and away from the user's head and the rear surface of the hair extension apparatus 11 is facing inward and toward the user's head. The user can then place the plurality of tines 15 of the clamps 13 into the user's hair and push the tines 15 into the strands of the user's hair toward the head of the user such that the strands of hair are interlocked with the plurality of tines 15 and thus secured into the user's hair. The user can then close the closure member of the clamp 13 via pushing the plurality of teeth 20 of the closure member 18 between the plurality of tines 15 thus securing the hair extension apparatus into the user's hair such that the hair extension apparatus 11 will not be dislodged from the user's hair and will not fall therefrom.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair extension attachment apparatus, comprising:

(a) an elongated strip having a first end, a second end, a front surface, and a rear surface;

(b) at least a pair of clamps secured to the front surface of the elongated strip for removably securing the strip to a user's hair, each of said clamps comprises a closure member including a plurality of teeth and a corresponding plurality of parallel tines, each closure member mounted to the strip for rotation thereto and adapted to rotate from an open to a closed position and rotate the teeth into removable engagement with the plurality of tines of the clamp when the closure member is in the closed position so as to secure the user's hair therebetween; and (c) a plurality of hook fasteners disposed on the front surface of the elongated strip for removably securing a hair extension thereto, each one of the plurality of hook fasteners extending outwardly from the front surface of the elongated strip, each one of the plurality of hook fasteners including a portion extending substantially parallel to the strip to define a hollow channel formed therebetween, the hook fasteners being disposed on each side of each clamp.

2. The hair extension attachment apparatus of claim 1, wherein the elongated strip is a flexible elongated strip.

3. The hair extension attachment apparatus of claim 1, wherein each one of the at least a pair of clamps is spaced apart from each other at a fixed interval.

4. The hair extension attachment apparatus of claim 1, wherein each one of the plurality of hook fasteners is spaced apart from each other at a fixed interval.

5. The hair extension attachment apparatus of claim 1, wherein each one of the plurality of parallel tines is spaced apart from each other at a fixed interval.

6. The hair extension attachment apparatus of claim 1, wherein the closure member is substantially rectangular.

7. The hair extension attachment apparatus of claim 1, wherein the at least a pair of clamps and the plurality of hook fasteners are arranged in an alternating fashion on the elongated strip.

8. A hair extension attachment apparatus, comprising:

(a) an elongated strip having a first end, a second end, a front surface, and a rear surface;

(b) a first clamp, a second clamp, and a third clamp, each clamp secured to the front surface of the elongated strip for removably securing the strip to a user's hair, each clamp including a closure member hingedly connected at one end to the strip and rotatable between a hair-receiving, or open, position generally perpendicular to the strip and a hair-holding, or closed, position generally parallel to the strip, and retaining means for releasably retaining the closure member in the hair holding position;

(c) at least one first hook fastener and at least one second hook fastener, the at least one first and second hook fastener being disposed on the front surface of the elongated strip for removably securing a hair extension thereto;

wherein the at least one first hook fastener is interposed between the first clamp and the second clamp; and further wherein the at least one second hook fastener is interposed between the second clamp and the third clamp.

9. A hair extension attachment apparatus, comprising:

(a) an elongated strip having a first end, a second end, a front surface, and a rear surface;

(b) at least three clamps secured to the front surface of the elongated strip for removably securing the strip to a user's hair, each clamp including a closure member hingedly connected at one end to the strip and rotatable between a hair-receiving, or open, position and a hair-holding, or closed, position juxtaposed with the front surface of the strip, and retaining means for releasably retaining the closure member in the hair holding position;

(c) a plurality of hook fasteners disposed on the front surface of the elongated strip for removably securing a hair extension thereto, each one of the plurality of hook fasteners extending outwardly from the front surface of the elongated strip, each one of the plurality of hook fasteners including a portion extending substantially parallel to the strip to define a hollow channel formed therein; and wherein the at least three clamps and the plurality of hook fasteners are arranged in an alternating fashion on the elongated strip.

* * * * *